US006923274B2

(12) United States Patent
Rodgers et al.

(10) Patent No.: US 6,923,274 B2
(45) Date of Patent: Aug. 2, 2005

(54) RETRIEVABLE PRE-MILLED WINDOW WITH DEFLECTOR

(75) Inventors: Ken Dale Rodgers, Aurora, CO (US); Mark C. Glaser, Houston, TX (US); Doug Durst, Katy, TX (US); Mike Johnson, Odessa, TX (US); Steve R. Delgado, Houston, TX (US); Mark Ryan, Louise, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 159 days.

(21) Appl. No.: 10/335,979

(22) Filed: Jan. 2, 2003

(65) Prior Publication Data

US 2004/0129458 A1 Jul. 8, 2004

(51) Int. Cl.[7] ..... E21B 7/08; E21B 7/06

(52) U.S. Cl. ..... 175/61; 166/50; 166/117.6; 166/242.5; 166/313

(58) Field of Search ..... 166/313, 381, 166/384, 50, 117.5, 117.6, 162, 169, 241.1, 242.1, 242.5; 175/61, 62

(56) References Cited

U.S. PATENT DOCUMENTS

| | | | | | |
|---|---|---|---|---|---|
| 4,573,541 | A | * | 3/1986 | Josse et al. | 175/78 |
| 5,431,223 | A | * | 7/1995 | Konopczynski | 166/117.5 |
| 5,531,271 | A | * | 7/1996 | Carter | 166/117.6 |
| 5,941,308 | A | * | 8/1999 | Malone et al. | 166/313 |
| 5,944,107 | A | * | 8/1999 | Ohmer | 166/313 |
| 5,960,873 | A | * | 10/1999 | Alexander et al. | 166/50 |
| 5,979,560 | A | * | 11/1999 | Nobileau | 166/381 |
| 6,019,173 | A | * | 2/2000 | Saurer et al. | 166/98 |
| 6,047,774 | A | * | 4/2000 | Allen | 166/313 |
| 6,135,208 | A | * | 10/2000 | Gano et al. | 166/313 |
| 6,189,616 | B1 | * | 2/2001 | Gano et al. | 166/298 |
| 6,244,340 | B1 | * | 6/2001 | McGlothen et al. | 166/255.3 |
| 6,302,215 | B1 | * | 10/2001 | Gotlib et al. | 166/374 |
| 6,533,040 | B2 | * | 3/2003 | Gondouin | 166/380 |
| 6,585,040 | B2 | * | 7/2003 | Hanton et al. | 166/50 |
| 2001/0009189 | A1 | * | 7/2001 | Brooks et al. | 166/50 |
| 2001/0025710 | A1 | * | 10/2001 | Ohmer et al. | 166/313 |
| 2002/0079102 | A1 | * | 6/2002 | Dewey et al. | 166/313 |
| 2002/0162690 | A1 | * | 11/2002 | Hanton et al. | 175/73 |
| 2004/0011529 | A1 | * | 1/2004 | McGarian et al. | 166/313 |
| 2004/0035581 | A1 | * | 2/2004 | Cavender | 166/313 |
| 2004/0055752 | A1 | * | 3/2004 | Restarick et al. | 166/313 |

FOREIGN PATENT DOCUMENTS

| | | |
|---|---|---|
| GB | 2 373 520 | 9/2002 |

OTHER PUBLICATIONS

U.K. Search Report, Application No. GB 0330240.3, dated Mar. 17, 2004.

* cited by examiner

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

An apparatus for drilling one or more holes at an angle to a wellbore. The apparatus includes a tubular housing defining one or more openings. Each opening is configured to provide an exit through which a drilling assembly drills to form a hole at an angle to the wellbore. The apparatus further includes one or more deflectors. Each deflector defines a surface for guiding the drilling assembly through an opening, and each deflector is positioned inside the tubular housing such that the surface is facing the opening. The apparatus further includes an anchor having a bottom portion attached to a top portion of the tubular housing and having a top portion configured to be removably fixed to a conveyance tubular.

47 Claims, 5 Drawing Sheets

RETRIEVABLE PRE-MILLED WINDOW WITH DEFLECTOR

BACKGROUND OF THE INVENTION

1. Field of the Invention

The present invention relates to oil field tools, and more specifically, to a deflector assembly.

2. Description of the Related Art

Historically, oil field wells are drilled as a vertical shaft to a subterranean producing zone forming a wellbore, the wellbore is lined with a steel tubular casing, and the casing is perforated to allow production fluid to flow into the casing and up to the surface of the well. In recent years, oil field technology has increasingly used sidetracking or directional drilling to further exploit the resources of productive regions. In sidetracking, an exit, such as a slot or window, is cut in a steel cased wellbore typically using a mill, where drilling is continued through the exit at angles to the vertical wellbore. In directional drilling, a wellbore is cut in strata at an angle to the vertical shaft typically using a drill bit. The mill and the drill bit are rotary cutting tools having cutting blades or surfaces typically disposed about the tool periphery and in some models on the tool end.

Generally, components including an anchor, a deflector coupled to the anchor and a rotary milling assembly that progresses downward along the deflector are used to cut the angled exit through the casing in the wellbore. The deflector is an elongated cylindrical wedge-shaped member having an inclined concave deflection surface and guides the angle of the rotary milling assembly progressively outward to cut the exit. One or more of the components are attached to a tubing member, such as drill pipe or coiled tubing, that is used to lower the components into the wellbore. The anchor typically is a bridge plug, packer or another supporting or sealing member. The anchor is set in a downhole position and extends across the wellbore to form an abutting surface for placement of subsequent equipment.

Sidetracking or forming a lateral wellbore generally requires three "trips". The first trip sets the anchor in the wellbore, the second trip sets the deflector to the anchor and the third trip actuates the milling assembly to cut the exit along the deflector. Such operations are time consuming and expensive.

Therefore, a need exists for an improved method and apparatus of forming a lateral wellbore.

SUMMARY OF THE INVENTION

Embodiments of the present invention are generally directed to an apparatus for drilling one or more holes at an angle to a wellbore. In one embodiment, the apparatus includes a tubular housing defining one or more openings. Each opening is configured to provide an exit through which a drilling assembly drills to form a hole at an angle to the wellbore. The apparatus further includes one or more deflectors. Each deflector defines a surface for guiding the drilling assembly through an opening, and each deflector is positioned inside the tubular housing such that the surface is facing the opening. The apparatus further includes an anchor having a bottom portion attached to a top portion of the tubular housing and having a top portion configured to be removably fixed to a conveyance tubular.

In another embodiment, the apparatus further includes an orienting device configured to rotate at least one of the deflectors and the tubular housing to a desired direction.

In yet another embodiment, the present invention is directed to a method for drilling a hole at an angle to a wellbore. The method includes running a deflector assembly into the wellbore. The deflector assembly includes a tubular housing defining an opening and a deflector defining a surface for guiding a drilling assembly through the opening. The deflector is positioned inside the tubular housing such that the surface is facing the opening. The deflector assembly further includes an anchor having a bottom portion attached to a top portion of the tubular housing. The method further includes removably fixing a top portion of the anchor to a conveyance tubular.

In still another embodiment, the present invention is directed to a method for drilling one or more holes at an angle to a wellbore. The method includes running a deflector assembly into the wellbore. The deflector assembly includes a tubular housing defining a first opening and a second opening, and a first deflector and a second deflector positioned inside the tubular housing. The first deflector defines a surface facing the first opening and the second deflector defines a surface facing the second opening. The deflector assembly further includes an anchor having a bottom portion attached to a top portion of the tubular housing. The method further includes removably fixing a top portion of the anchor to a conveyance tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
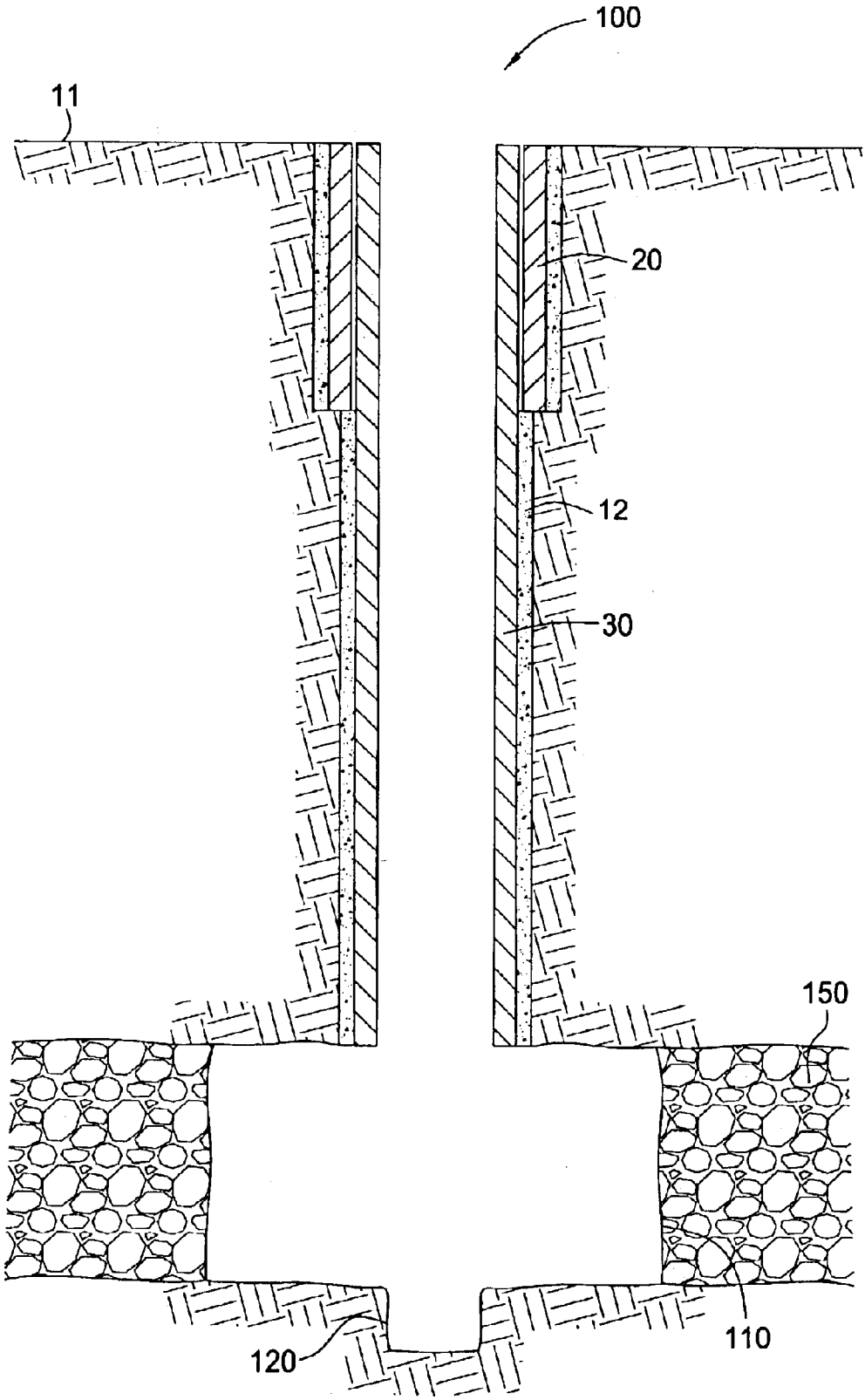
FIG. 1 illustrates a schematic cross sectional view of a wellbore, which is configured to incorporate embodiments of the present invention.

FIG. 1 illustrates a schematic cross sectional view of a wellbore 100, which is configured to incorporate embodiments of the present invention. The well is drilled through a surface 11 to establish the wellbore 100. Typically, the wellbore 100 is lined or cased with one or more strings, such as string 20 and string 30, each of which is a conveyance tubular. String 30 may be referred to as a production or liner string since it is the last string in a chain of strings. String 20 may be referred to as an intermediate string. A space 12 between the drilled wellbore 100 and string 20 and between the drilled wellbore 100 and string 30 is sealed with a solidifying aggregate, such as concrete or cement. An open hole 110 is created, such as by an under reamer, at the bottom of the wellbore 100. In one embodiment, the open hole 110 is created in or adjacent a formation 150, such as a coal bed seam. A rat hole 120 is drilled below the open hole 110. The rat hole 120 provides a hole in which a deflector assembly 200 (shown in FIG. 2) in accordance with an embodiment of the invention is placed. Accordingly, the rat hole 120 is generally drilled in a stable area supportive of heavy equipment, such as a shale beneath the formation 150.

Figure 2:
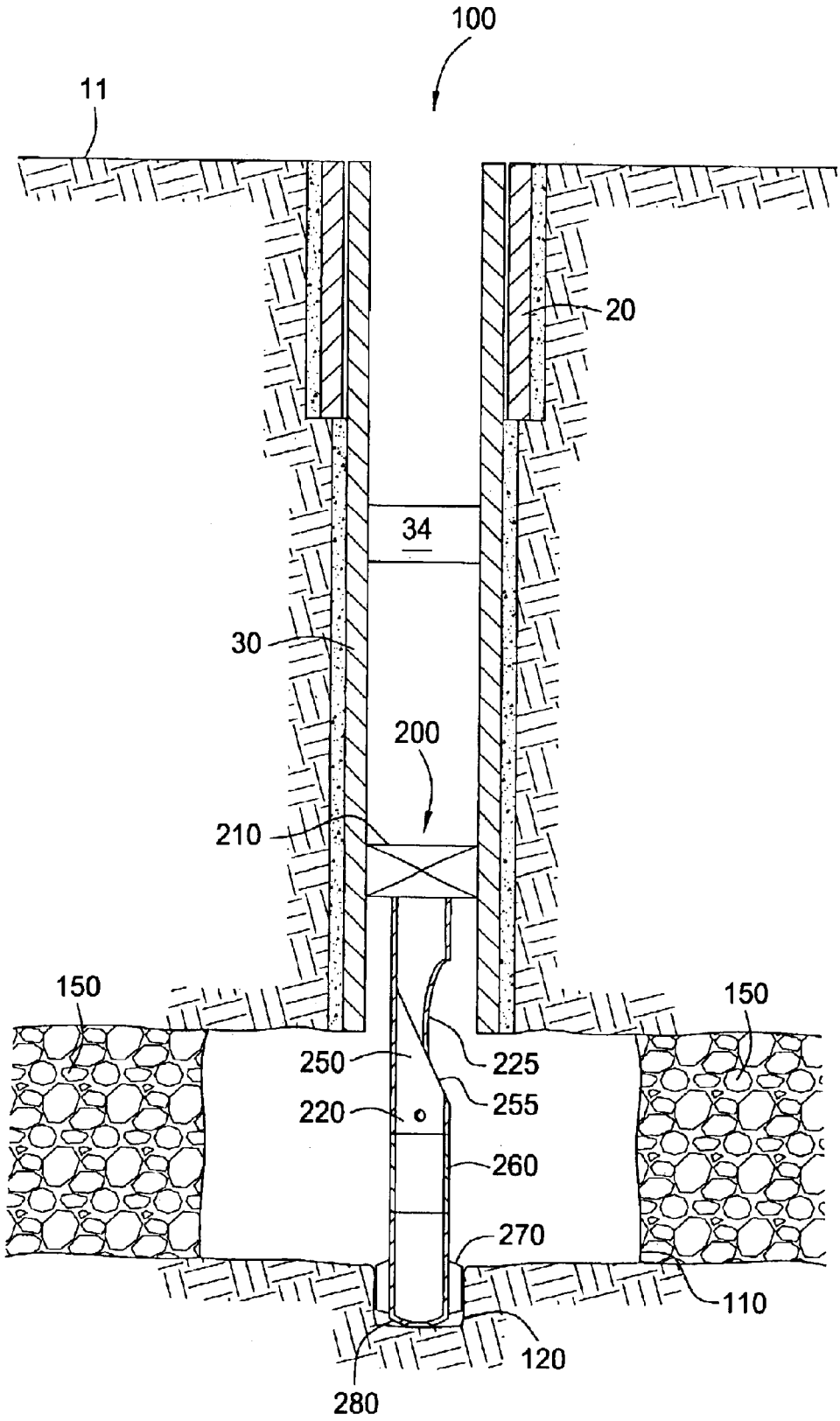
FIG. 2 illustrates a schematic cross sectional view of a deflector assembly disposed inside the wellbore in accordance with an embodiment of the invention.

FIG. 2 illustrates a schematic cross sectional view of the deflector assembly 200 disposed inside the wellbore 100 in accordance with an embodiment of the invention. The deflector assembly 200 includes an anchor 210, which may be a bridge plug, packer, liner hanger or other setting device. The anchor 210 is attached or fixed to the lower end of string 30. The anchor 210 may be mechanically actuated to set the anchor 210 in position, as known to those with ordinary skill in the art. The anchor 210 may be a Sure-Set Liner Hanger®, which is commercially available from Weatherford International, Inc. of Houston, Tex. A tubular housing 220 is coupled to the bottom portion of the anchor 210. As compared to string 20 or 30, the tubular housing 220 is not attached to the wellbore 100 by a solidifying aggregate. Thus, the tubular housing 220 is not permanently placed inside the wellbore 100. The tubular housing 220 defines an opening 225, which provides an exit for a drilling assembly to form a lateral wellbore into the adjacent formation 150, such as the coal bed seam. In one embodiment, the opening 225 is placed below the anchor 210. The deflector assembly 200 further includes a deflector 250, which may be a whipstock, disposed inside the tubular housing 220 and in front of the opening 225. The deflector 250 includes an elongated tapered surface 255 configured to guide the drilling assembly through the opening 225 to form a lateral wellbore into the adjacent formation 150. In one embodiment, the deflector 250 is permanently attached to an inside portion of the tubular housing 220. The deflector 250 may be attached by any conventional means, such as welding.

The deflector assembly 200 may further include one or more extensions, such as an extension 260. The extensions provide additional length to accurately place the deflector assembly 200 in the open hole where the new lateral wellbores will be formed. The extensions may vary in length, depending upon the location of the lateral wellbores. In some arrangements, a stabilizer sub 270 is attached to the deflector assembly 200. The stabilizer sub 270 has extensions protruding from the exterior surface to assist in concentrically retaining the deflector assembly 200 in the wellbore 100. A bull plug 280 having a rounded end may be attached to the bottom of the deflector assembly 200 to provide stability in the rat hole 120.

One advantage of the deflector assembly 200 is that the deflector assembly 200 may be run into the wellbore 100 in one trip. That is, the entire deflector assembly 200, including the anchor 210, the deflector 250, the tubular housing 220 with the opening 225, the extension 260, the stabilizer sub 270 and the bull plug 280 may be run into the wellbore 100 in one trip. Since the tubular housing 220 already defines the opening 225, running a milling assembly into the wellbore 100 and milling through a string or casing to provide an exit in the string is no longer necessary. In this manner, the number of trips required to drill lateral wellbores into the formation 150 is significantly reduced. This reduction in the number of trips in turn leads to a reduction in time and cost savings in well production and completion. In one embodiment, the deflector assembly 200 may be retrieved and reused. In another embodiment, the deflector 250 may be retrieved separately from the deflector assembly 200. The deflector assembly 200 or the deflector 250 may be run into the wellbore 100 and retrieved from the wellbore 100 by a wire line, tubing or other conventional methods.

Figure 4:
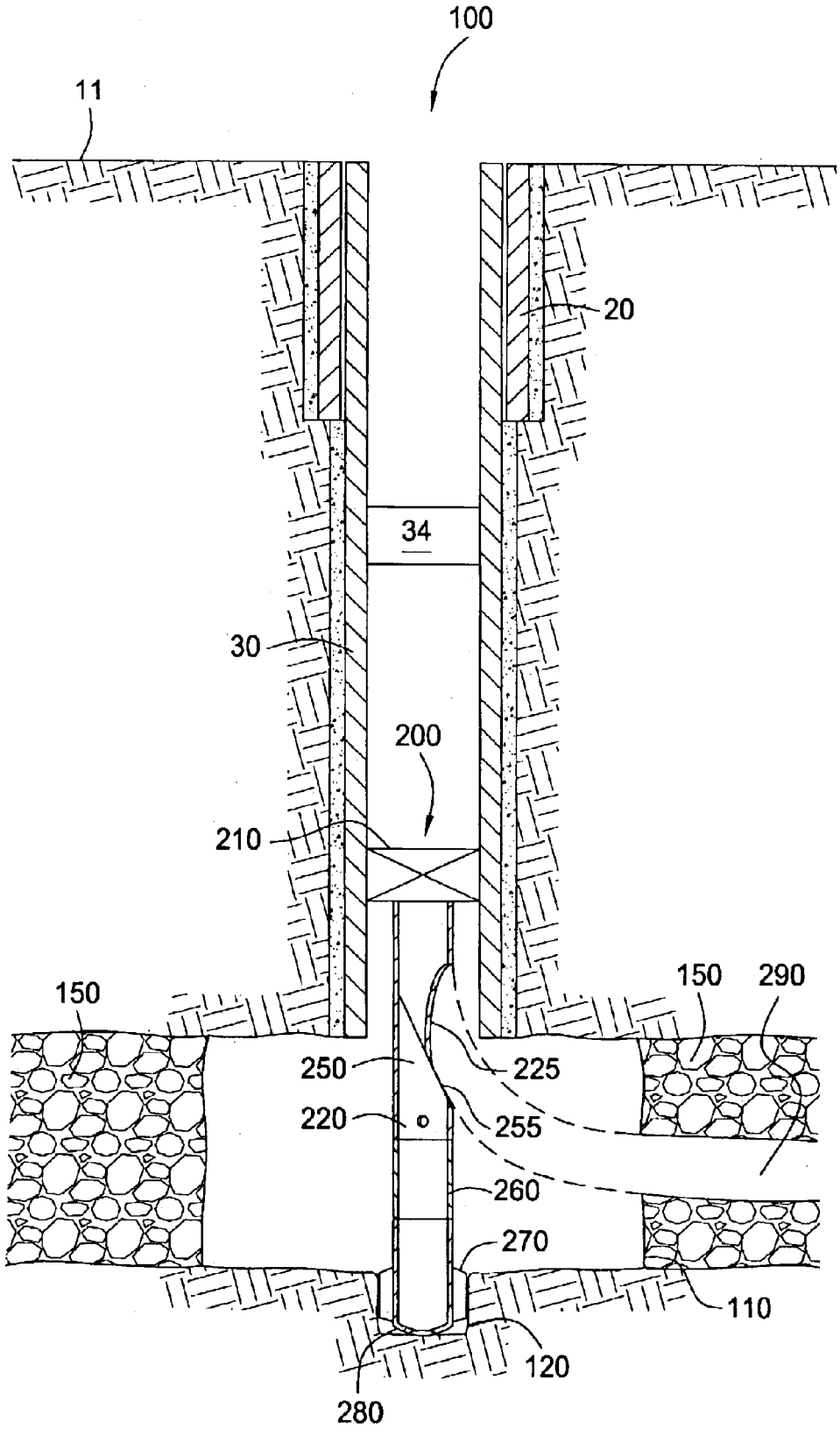
FIG. 4 illustrates a lateral wellbore formed by the drilling assembly guided by the deflector assembly in accordance with an embodiment of the invention.

In operation, after the open hole 110 and the rat hole 120 are created, the deflector assembly 200 is run into the wellbore 100. The bull plug 280, which is a component of the deflector assembly 200, is positioned inside the rat hole 120 to support the bottom portion of the deflector assembly 200. The anchor 210, which is a component of the deflector assembly 200, is removably fixed to a lower portion of string 30. Once the deflector assembly 200 is set up, a drilling assembly (not shown) is run into the wellbore 100 to form a lateral wellbore 290 (shown in FIG. 4) into the adjacent formation 150 through the opening 225 and guided by the deflector 250. FIG. 4 illustrates the lateral wellbore 290 formed by the drilling assembly guided by the deflector assembly 200 in accordance with an embodiment of the invention. Once the lateral wellbore 290 is formed, the drilling assembly is retrieved from the wellbore 100, followed by the deflector assembly 200. The drilling assembly may be run into the wellbore 100 and retrieved from the wellbore 100 by a wire line, tubing or other conventional methods. In one embodiment, only the deflector 250 is retrieved, while the rest of the deflector assembly 200 is left inside the wellbore 100. In another embodiment, the drilling assembly may be connected to the deflector 250 by a shearable member, such as, a bolt. In this manner, the drilling assembly and the deflector assembly 200 may be run into the wellbore 100 together, thereby saving an additional trip. The drilling assembly may be freed from the deflector assembly 200 by pushing the drilling assembly against the deflector 250, thereby shearing the shearable member.

In accordance with another embodiment of the invention, the deflector assembly 200 may be rotated or oriented by a shifting device or an orienting device or an orienting device 34. More particularly, the orienting device 34 is configured to rotate the deflector 250 and its corresponding opening 225 to a desired direction within the wellbore 100. The orienting device 34 may be driven by a variety of means, such as a fluid or a mechanical apparatus, which may include spring-loaded dogs, and/or an electrical apparatus, which may include a computer. In operation, once the deflector assembly 200 is run into the wellbore 100, the deflector 250 and its corresponding opening 225 may be oriented toward a desired direction. Once a lateral wellbore is formed into the adjacent formation 150 along the desired direction, the orienting device 34 may rotate the deflector 250 and its corresponding opening 225 to another direction for another lateral wellbore on the same plane as the first lateral wellbore. In this manner, multiple lateral wellbores may be formed on a single horizontal plane of the formation 150.

Figure 3:
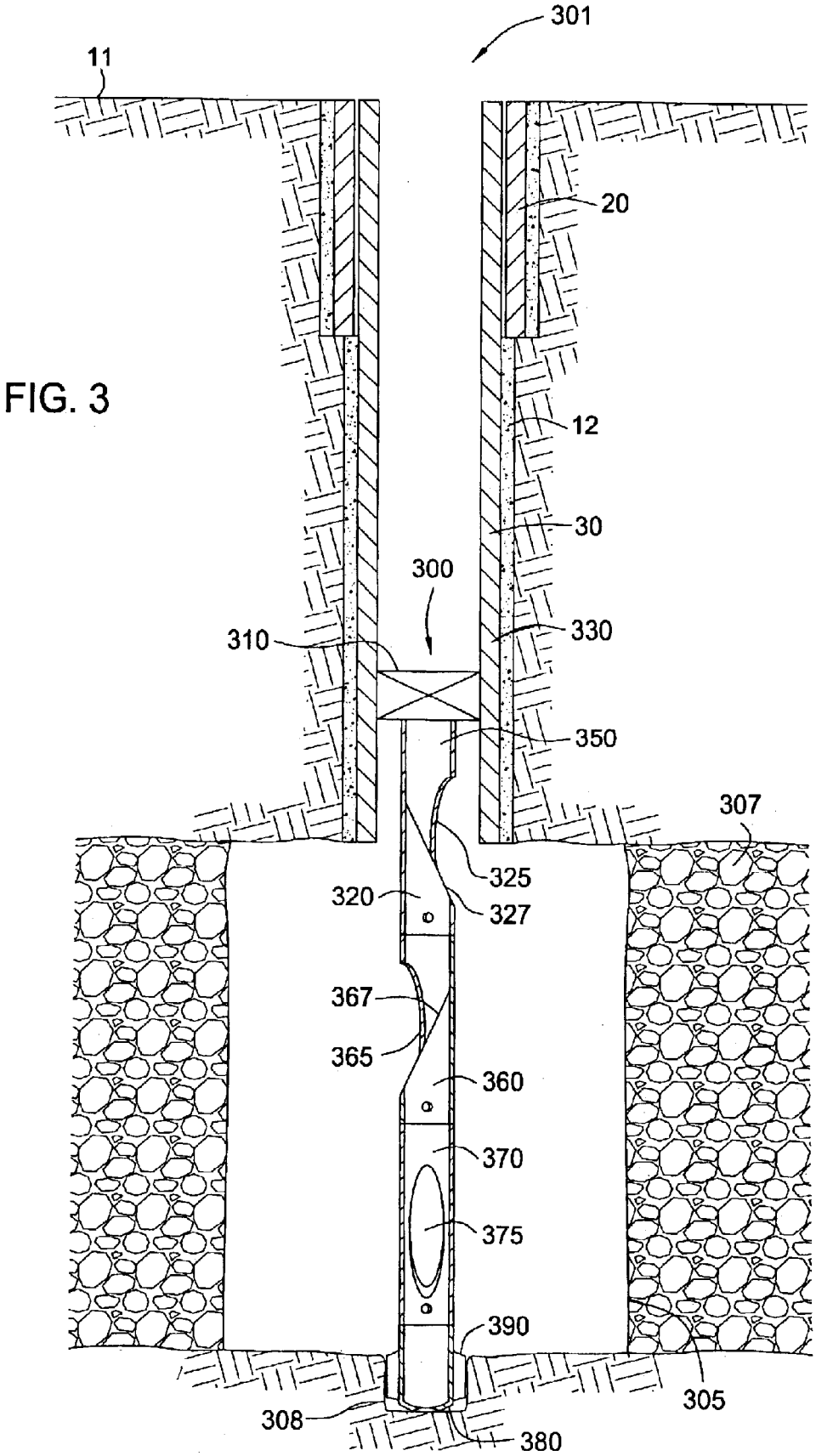
FIG. 3 illustrates a schematic cross section of a deflector assembly disposed inside the wellbore in accordance with another embodiment of the present invention.

FIG. 3 illustrates a schematic cross section of a deflector assembly 300 disposed inside a wellbore 301 in accordance with an embodiment of the present invention. The wellbore 301 defines an open hole 305 adjacent a formation 307. Below the open hole 305, a rat hole 308 is created to support the deflector assembly 300. The deflector assembly 300 includes an anchor 310 attached to string 330, which is the last permanent string at the bottom of the wellbore 301. The deflector assembly 300 further includes a tubular housing 350 attached to the bottom portion of the anchor 310. The tubular housing 350 defines a first opening 325, which provides an exit for a drilling assembly to form a first lateral wellbore into the adjacent formation 307. The deflector assembly 300 further includes a first deflector 320 disposed inside the tubular housing 350 and in front of the first opening 325. The first deflector 320 includes an elongated tapered surface 327 that guides a drilling assembly through the first opening 325 to form the first lateral wellbore 391 (shown in FIG. 5). In one embodiment, the first deflector 320 may be attached or welded to the inside portion of the tubular housing 350. In another embodiment, the first deflector 320 is retrievable from the tubular housing 350.

Figure 5:
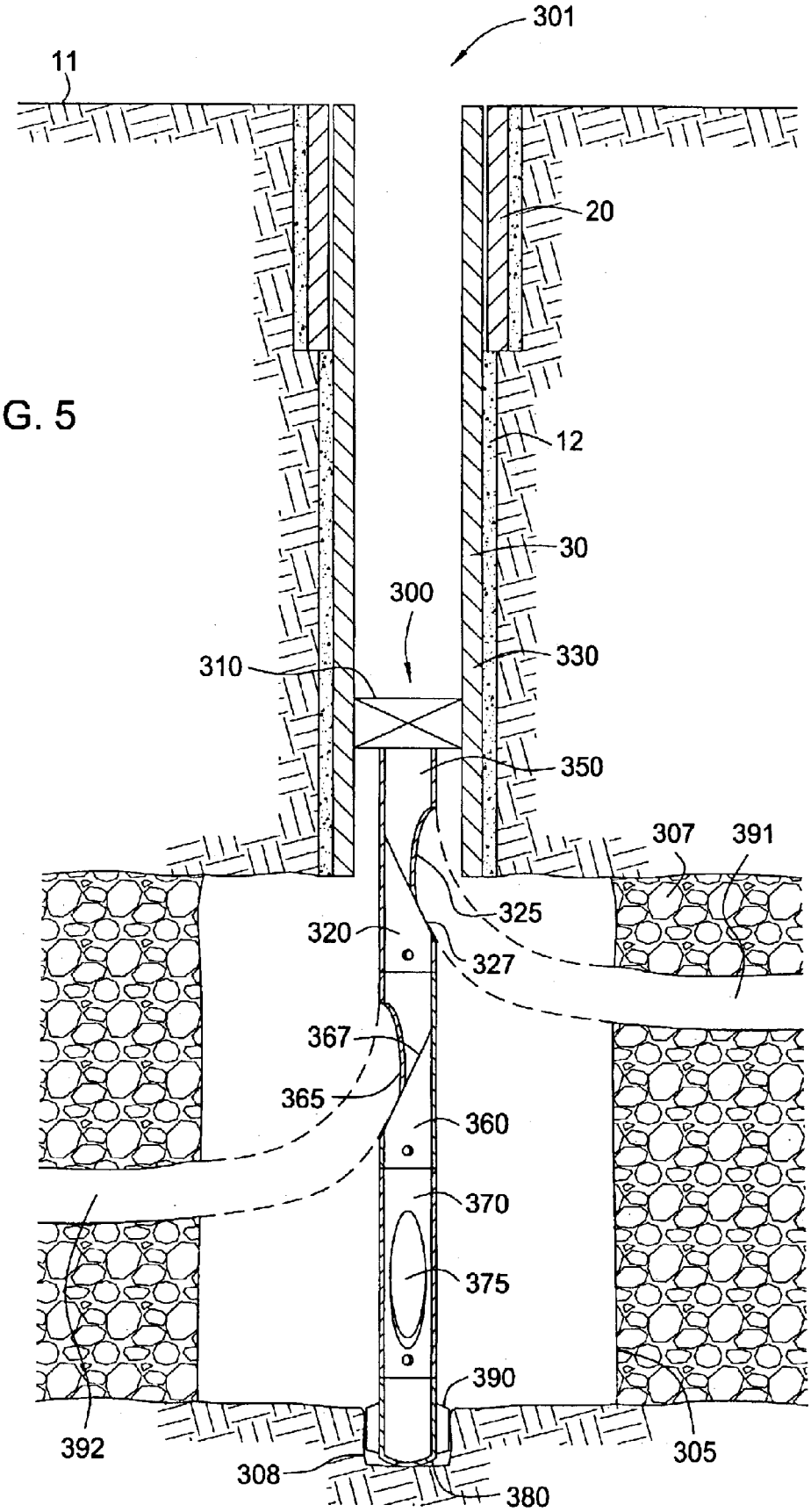
FIG. 5 illustrates the wellbores formed by the drilling assembly guided by the deflector assembly in accordance with an embodiment of the invention.

The tubular housing 350 further defines a second opening 365, which provides an exit for a drilling assembly to form a second lateral wellbore 392 (shown in FIG. 5). The deflector assembly 300 further includes a second deflector 360 disposed inside the tubular housing 350 and in front of the second opening 365. The second deflector 360 includes an elongated tapered surface 367 that guides a drilling assembly through the second opening 365 to form the second lateral wellbore 392. In one embodiment, the second deflector 360 may be attached or welded to the inside portion of the tubular housing 350. In another embodiment, the second deflector 360 is retrievable from the tubular housing 350.

The tubular housing 350 further defines a third opening 375, which provides an exit for a drilling assembly to form a third lateral wellbore (not shown). The deflector assembly 300 further includes a third deflector 370 disposed inside the tubular housing 350 and in front of the third opening 375. The third deflector 370 includes an elongated tapered surface (not shown) that guides a drilling assembly through the third opening 375 to form the third lateral wellbore. In one embodiment, the third deflector 370 may be attached or welded to the inside portion of the tubular housing 350.

The deflector assembly 300 further includes a stabilizer sub 390, which has extensions protruding from the exterior surface to assist in concentrically retaining the deflector assembly 300 in the wellbore 301. A bull plug 380 having a rounded end may be attached to the bottom of the deflector assembly 300 to provide stability in the rat hole 308.

In one embodiment, the first opening 325 and the first deflector 320 may be oriented in the same direction as the second opening 365 and the second deflector 360, and as the third opening 375 and the third deflector 370. In this manner, the deflector assembly 300 is configured to form three substantially horizontal parallel lateral wellbores. In another embodiment, the first opening 325 and the first deflector 320 may be oriented in one direction, while the second opening 365 and the second deflector 360 and the third opening 375 and the third deflector 370 may be oriented in two different directions. For example, the first opening 325 may be oriented 180 degrees from the orientation of the second opening 365 and 90 degrees from the orientation of the third opening 375, as shown in FIG. 3.

In operation, after the open hole 305 and the rat hole 308 are created, the deflector assembly 300 is run into the wellbore 301. The bull plug 380, which is a component of the deflector assembly 300, is positioned inside the rat hole 308 to support the bottom portion of the deflector assembly 300. The anchor 310, which is a component of the deflector assembly 300, is removably fixed to a lower portion of string 330. A drilling assembly (not shown) is run into the wellbore 301 to form the first lateral wellbore 391 into the adjacent formation 307 through the first opening 325 and guided by the first deflector 320. Once the first lateral wellbore 391 is formed, the drilling assembly is retrieved from the wellbore 301, followed by the first deflector 320. The drilling assembly is run into the wellbore 301 for a second time to form the second lateral wellbore 392 into the adjacent formation 307 through the second opening 365 and guided by the second deflector 360. Once the second lateral wellbore 392 is formed, the drilling assembly is retrieved from the wellbore 301, followed by the second deflector 360. The drilling assembly is then run into the wellbore 301 for a third time to form the third lateral wellbore into the adjacent formation 307 through the third opening 375 and guided by the third deflector 370. Once the third lateral wellbore is formed, the drilling assembly is retrieved from the wellbore 301, followed by the deflector assembly 300, including the third deflector 370. The deflector assembly 300 having three deflectors is described herein for illustrative purposes only. The deflector assembly 300 may include any number of deflectors and with varying orientation.

Alternatively, the above method may be processed in reverse order. That is, when the deflector assembly 300 is run into the wellbore 301, the deflector assembly 300 only includes the third deflector 370. After the third lateral wellbore is formed through the third opening 375, the second deflector 360 is run into the wellbore 301 and positioned inside the tubular housing 350 facing the second opening 365. The second lateral wellbore 392 is then formed by the drilling assembly drilling through the second opening 365 and guided by the second deflector 360. Afterwards, the first deflector 320 is run into the wellbore 301 and positioned inside the tubular housing 350 facing the first opening 325 and the first lateral bore is then formed by the drilling assembly drilling through the first opening 325 and guided by the first deflector 320. Once all three lateral wellbores have been formed, the deflector assembly 330 is retrieved from the wellbore 301. FIG. 5 illustrates two of the three wellbores formed by the drilling assembly guided by the deflector assembly 300 in accordance with an embodiment of the invention.

Alternatively, the third deflector 370 may be positioned in front of the second opening 365 and the first opening 325, instead of running in the second deflector 360 and the first deflector 320.

While the foregoing is directed to embodiments of the present invention, other and further embodiments of the invention may be devised without departing from the basic scope thereof, and the scope thereof is determined by the claims that follow.

What is claimed is:

1. An apparatus for drilling one or more holes at an angle to a wellbore, comprising:

at least one continuous tubular housing defining a plurality of openings, wherein each opening is configured to provide an exit through which a drilling assembly drills to form a hole at an angle to the wellbore;

a plurality of deflectors, wherein each deflector is configured to guide the drilling assembly through one of the openings; and where in the apparatus is deployable into the wellbore as an integrated unit.

2. The apparatus of claim 1, wherein the integrated unit is configured to move within the wellbore in order to drill at least one more hole.

3. The apparatus of claim 1, further comprising a conveyance tubular, wherein the tubular housing is configured to move relative to the conveyance tubular.

4. The apparatus of claim 3, wherein the tubular housing is retrievable from the wellbore.

5. The apparatus of claim 1, further comprising an anchor attached to the tubular housing and configured to be removably fixed within the wellbore.

6. An apparatus for drilling one or more holes at an angle to a wellbore, comprising:

at least one continuous tubular housing defining at least two openings, wherein each opening is configured to provide an exit through which a drilling assembly drills to form a hole at an angle to the wellbore;

at least two deflectors, wherein each deflector defines a surface for guiding the drilling assembly through one of the openings, and wherein each deflector is positioned inside the tubular housing such that the surface is facing the opening; and an anchor having a portion attached to the tubular housing and having another portion configured to be removably fixed to a conveyance tubular.

7. The apparatus of claim 6, wherein the openings are oriented in different directions.

8. The apparatus of claim 6, wherein each deflector is removably attached to an inside portion of the tubular housing.

9. The apparatus of claim 6, wherein each deflector is attached to an inside portion of the tubular housing.

10. The apparatus of claim 6, wherein the anchor is retrievable from the wellbore.

11. The apparatus of claim 6, wherein each deflector is retrievable from the wellbore.

12. The apparatus of claim 6, wherein the anchor is positioned above the openings.

13. The apparatus of claim 6, further comprising one or more extensions attached to the tubular housing, wherein the extensions are configured to provide additional length to the tubular housing.

14. The apparatus of claim 13, further comprising a stabilizer sub attached to the extensions.

15. The apparatus of claim 14, further comprising a bull plug attached to the stabilizer sub.

16. The apparatus of claim 6, further comprising an orienting device configured to rotate at least one of the defectors and the tubular housing to a desired direction.

17. A method for drilling one or more holes at an angle to a wellbore, comprising:

running a deflector assembly into the wellbore, wherein the deflector assembly comprises a tubular housing defining a plurality of openings and a plurality of deflectors for guiding a drilling assembly through the plurality of openings; and drilling one or more holes.

18. The method of claim 17, wherein each deflector is positioned inside the tubular housing such that a surface defined on the deflector faces one of the openings.

19. The method of claim 17, wherein the deflector assembly further comprises an anchor attached to the tubular housing and the method further comprises removably fixing the anchor within the wellbore.

20. The method of claim 17, further comprising positioning a bottom portion of the deflector assembly inside the wellbore.

21. The method of claim 17, further comprising drilling the hole at an angle to the wellbore through the opening and guided by the deflector.

22. The method of claim 17, further comprising running the drilling assembly into the wellbore.

23. The method of claim 22, further comprising retrieving the drilling assembly from the wellbore.

24. The method of claim 23, further comprising retrieving the deflector assembly from the wellbore.

25. The method of claim 23, further comprising retrieving the deflector from the wellbore.

26. The method of claim 17, further comprising rotating the deflector and the opening to a desired direction.

27. The method of claim 17, wherein a drilling assembly is releasably connected to the deflecting assembly.

28. The method of claim 27, further including separating the drilling assembly from the deflector assembly prior to drilling the at least one hole.

29. A method for drilling one or more holes at an angle to a wellbore, comprising:

running a deflector assembly into the wellbore, wherein the deflector assembly comprising:

a tubular housing defining a first opening and a second opening;

a first deflector and a second deflector positioned inside the tubular housing, wherein the first deflector defines a surface facing the first opening and the second deflector defines a surface facing the second opening; and an anchor attached to the tubular housing;

removably fixing a portion of the anchor to a conveyance tubular; and positioning the deflector assembly inside the wellbore.

30. The method of claim 29, further comprising drilling a first hole at an angle to the wellbore through the first opening guided by the first deflector.

31. The method of claim 30, further comprising retrieving the first deflector after drilling the first hole.

32. The method of claim 31, further comprising drilling a second hole at angle to the wellbore through the second opening guided by the second deflector.

33. The method of claim 32, further comprising retrieving the deflector assembly after drilling the second hole.

34. The method of claim 29, wherein the first opening is positioned above the second opening.

35. The method of claim 29, wherein the first deflector is positioned above the second deflector.

36. A method for drilling one or more holes at an angle to a wellbore, comprising:

running a deflector assembly into the wellbore, wherein the deflector assembly comprises:

at least one continuous tubular housing defining a first opening and a second opening; and a first deflector positioned inside the tubular housing, wherein the first deflector defines a surface facing the first opening;

drilling a first hole at an angle to the wellbore through the first opening guided by the first deflector;

repositioning the first deflector adjacent the second opening; and drilling a second hole at an angle to the wellbore through the second opening guided by the first deflector.

37. The method of claim 36, further comprising retrieving the first deflector after drilling the first hole.

38. The method of claim 36, further comprising retrieving the deflector assembly after drilling the second hole.

39. The method of claim 36, wherein the first opening and the second opening are oriented in different directions.

40. The method of claim 36, wherein the second opening is positioned above the first opening.

41. The method of claim 36, further including removably fixing the deflector assembly in the wellbore.

42. A method for drilling one or more holes at an angle to a wellbore, comprising:

running a deflector assembly into the wellbore, wherein the deflector assembly comprises:

a tubular housing defining a first opening and a second opening;

a first deflector positioned inside the tubular housing, wherein the first deflector defines a surface facing the first opening; and an anchor attached to the tubular housing;

removably fixing a portion of the anchor to a conveyance tubular;

positioning the deflector assembly inside the wellbore; and drilling a first hole at an angle to the wellbore through the first opening guided by the first deflector; and positioning a second deflector inside the tubular housing such that a surface defined by the second deflector faces the second opening after drilling the first hole.

43. The method of claim 42, further comprising drilling a second hole at an angle to the wellbore through the second opening guided by the surface defined by the second deflector.

44. The method of claim 42, wherein the second deflector is positioned above the first deflector.

45. An assembly for drilling one or more holes at an angle to a wellbore, comprising:

a deflector assembly for directing a drilling assembly at an angle to the wellbore, wherein the deflector assembly includes a tubular housing with two or more openings and one or more deflectors; and an orientating device for rotating the deflector assembly to at least two positions along the same plane.

46. The assembly of claim 45, including an anchor operatively attached to the tubular housing and configured to be removably fixed within the wellbore.

47. A method for drilling at least two wellbores from a central wellbore, comprising:

running a deflector assembly in the central wellbore, the deflector assembly comprises a first and second deflector and a tubular housing defining a first and a second opening;

drilling a first wellbore through the first opening guided by the first deflector;

removing the first deflector from the deflector assembly; and drilling a second wellbore through the second opening guided by the second deflector.

* * * * *